US007470091B2

(12) United States Patent
Scholl

(10) Patent No.: US 7,470,091 B2
(45) Date of Patent: Dec. 30, 2008

(54) ASSEMBLY AND METHOD FOR PROTECTING A PIER AND A POST COMBINATION

(76) Inventor: Richard Scholl, 8 Dogwood Ct., Saint Peters, MO (US) 63376

( * ) Notice: Subject to any disclaimer, the term of this patent is extended or adjusted under 35 U.S.C. 154(b) by 306 days.

(21) Appl. No.: 11/387,335

(22) Filed: Mar. 23, 2006

(65) Prior Publication Data

US 2007/0224002 A1 Sep. 27, 2007

(51) Int. Cl.
*E02D 31/02* (2006.01)

(52) U.S. Cl. ..... 405/231; 405/229; 52/169.13; 52/297

(58) Field of Classification Search ..... 405/211, 405/216, 231, 229; 52/40, 170, 296, 297, 52/169.13, 720.1, 721.4, 721.5, 723.1, 723.2, 52/726.4; 256/1
See application file for complete search history.

(56) References Cited

U.S. PATENT DOCUMENTS 816,719 A * 4/1906 Fell ..... 52/297
1,596,657 A * 8/1926 Heber ..... 52/168
4,252,471 A * 2/1981 Straub ..... 405/211
D349,164 S 7/1994 Fox
5,369,925 A * 12/1994 Vargo ..... 52/244
5,435,667 A * 7/1995 Strange ..... 405/216
5,503,371 A 4/1996 Bies
5,622,356 A 4/1997 Duggan
5,685,522 A 11/1997 Randolph, Jr.
5,832,675 A 11/1998 Zuares
5,853,167 A 12/1998 West et al.
6,073,416 A * 6/2000 Peter ..... 52/736.4
6,098,353 A * 8/2000 Stanfield ..... 52/170
6,119,421 A * 9/2000 Koyano ..... 52/296
6,256,961 B1 * 7/2001 Byrnes ..... 52/736.4
6,257,557 B1 7/2001 Anderson et al.
6,364,575 B1 * 4/2002 Bradley et al. ..... 405/216
6,494,640 B2 * 12/2002 Roller ..... 405/216
6,543,182 B2 * 4/2003 Snell et al. ..... 43/132.1
6,591,570 B2 7/2003 Miller, Jr.
6,878,325 B2 4/2005 Drake
7,104,525 B2 * 9/2006 Ricci ..... 256/1
2001/0000548 A1 5/2001 Nichaus
2001/0022056 A1 9/2001 Gifford
2002/0023382 A1 * 2/2002 Snell et al. ..... 43/132.1
2002/0094239 A1 * 7/2002 Bradley et al. ..... 405/216
2003/0085482 A1 * 5/2003 Sincock et al. ..... 264/32
2003/0168649 A1 * 9/2003 Weese ..... 256/1

(Continued)

OTHER PUBLICATIONS

JelliRoll Ergonomic Products, Fence Protector, http://gallery.bcentral.com/GID4729090P1398373-Fence-Protector/4×4 -Fence-Post-Protect.htm.

(Continued)

*Primary Examiner*—Frederick L Lagman
(74) *Attorney, Agent, or Firm*—Polster, Lieder, Woodruff & Lucchesi, L.C.

(57) ABSTRACT

A protective covering and method for enclosing a pier and a post mounted to the pier and their connection that includes a body having perimeter wall defining a top end and a bottom end, an upper aperture disposed around the top end, a lower aperture disposed around the bottom end, and a cavity and a seal disposed proximate the upper aperture for compressively engaging an outer surface of the post.

32 Claims, 8 Drawing Sheets

U.S. PATENT DOCUMENTS

| | | | |
|---|---|---|---|
| 2005/0005540 | A1 | 1/2005 | Nesbitt |
| 2005/0076586 | A1 | 4/2005 | Venegas, Jr. et al. |
| 2006/0038163 | A1 | 2/2006 | Ricci |

OTHER PUBLICATIONS

Post II Protector, http://www.postprotector.com/price.htm.
Post II Protector, http://www.postprotector.com/index.html.
Belson, Ultra Post Protector Plus Bollard Covers, http://www.belson.com/uppp.htm.
Ultra Post Protectors, www.belson.com/uppp.htm.
Ultra I-Beam Protectors, www.belson.com/uppp.htm.
Google search, post protector, http://www.google.com/search?q=%22post+protector%22=and-decorative&hl=e&lr=&sta.htm.
Google search, post protector decorative, InventHelp, http://72.14.207.104/search?Q=cache:nkdyPepc3t8J:www.inventhelp.com/invention.

* cited by examiner

ASSEMBLY AND METHOD FOR PROTECTING A PIER AND A POST COMBINATION

FIELD

The present disclosure relates to construction and, more specifically, to outdoor construction of a pier and a post combination.

BACKGROUND

The statements in this section merely provide background information related to the present disclosure and may not constitute prior art.

Posts and concrete piers are common structural components in the construction of decks, fences, outdoor lights and mailboxes. When the post material is of wooden material, the engaging of the post member to the concrete pier/base is often via offset metal plate structures having holes for securing the post with fasteners such as bolts, screws and nails.

Over time, the wooden post/concrete pier structure can be subjected to weather extremes (heat, cold, rain, ice, snow, etc.); destructive physical contact by yard maintenance equipment and the structure can deteriorate. Structural component deterioration can include oxidation of the metal plate materials and fasteners and decomposition of the wooden post, necessitating a costly replacement of the support structural elements or replacement of the complete structure.

The service life of the post/pier structural assembly can be lengthened and costly repairs and replacements avoided by environmentally protecting the assembly with a durable protective enclosure. Such protective assemblies can find application with both existing and new construction post/pier assemblies and can have the added benefit of improving the aesthetic appearance of the structure.

SUMMARY

The inventor hereof has succeeded at designing post/pier assembly enclosures that are capable of providing environmental protection to the post/pier assembly structural components while improving the aesthetic appearance of the structure.

According to one aspect, an assembly for enclosing a connection between a pier and a post mounted to the pier that includes a body having a perimeter wall defining a top end and a bottom end, an upper aperture disposed around the top end, a lower aperture disposed around the bottom end, and a cavity. A seal is disposed proximate the upper aperture for compressively engaging an outer surface of the post surrounded by the upper aperture.

According to another aspect, a protective base for a post mounted to a pier includes means for enclosing a bottom portion of the post and a top portion of the pier, and means for preventing fluid located about the post from entering into a cavity defined by the means for enclosing.

According to yet another aspect, a method of covering a pier and post mounted to the pier includes enclosing a portion of the pier and the bottom portion of the post within a cavity of a body and compressively engaging a seal about an outer surface of the post for preventing fluid located about the post from entering the cavity.

Further aspects of the present invention will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

Figure 1:
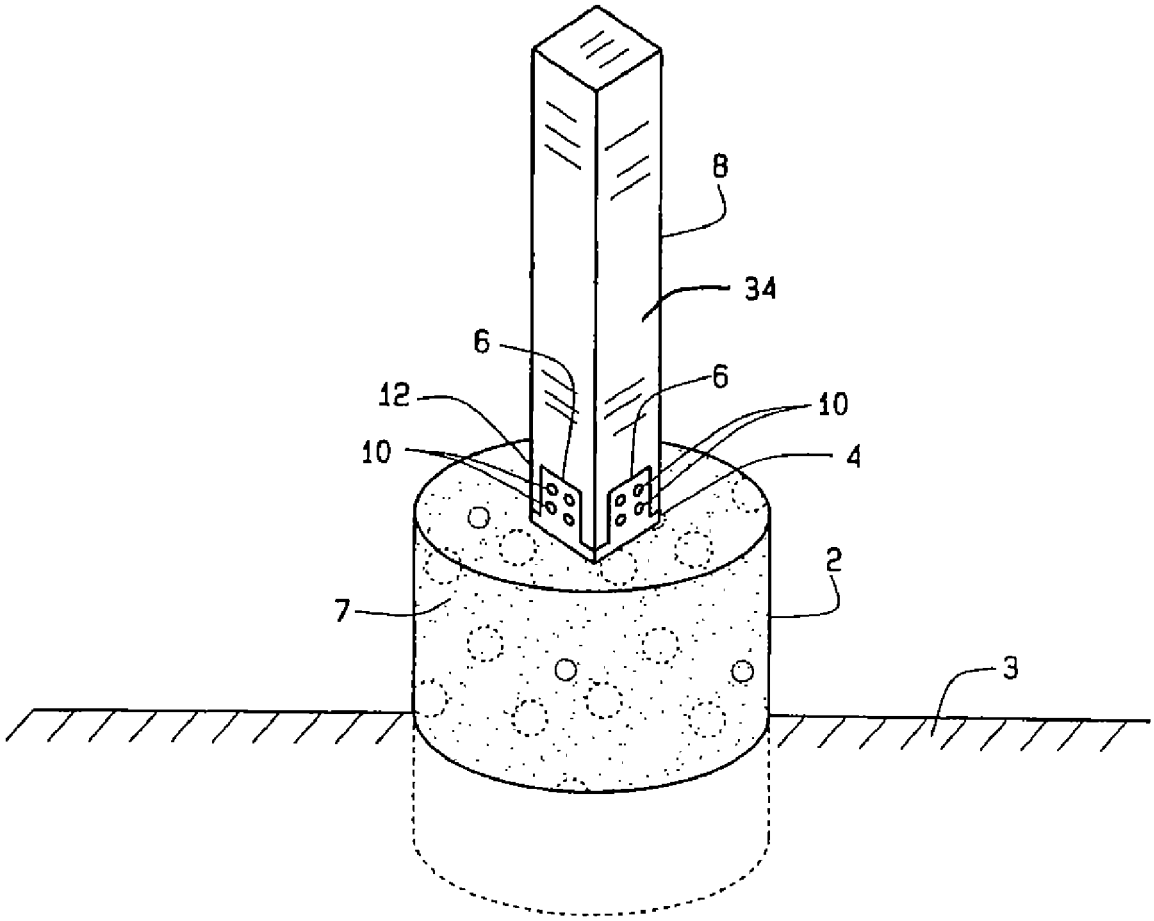
PRIOR ART FIG. 1
FIG. 1 is an isometric view of a post mounted to a pier.

The following description is merely exemplary in nature and is not intended to limit the present disclosure or the disclosure's applications or uses.

In some embodiments, an assembly for enclosing a connection between a pier and a post mounted to the pier that includes a body having a perimeter wall defining a top end and a bottom end, an upper aperture disposed around the top end, a lower aperture disposed around the bottom end, and a cavity. A seal is disposed proximate the upper aperture for compressively engaging an outer surface of the post surrounded by the upper aperture. The seal can be composed of a flexible and/or resilient material such as rubber, plastic, silicone, or a composite. By compressively engaging the outer surface, the seal can deflect/direct water or moisture running down the outer surface of the post onto the seal and away from the post.

The seal can include a first portion positioned about the upper aperture and a second portion projecting into the upper aperture for compressively engaging the outer surface of the post and for capturing and redirecting water or debris from the post and away from entering the cavity. Similarly, the body can include a sloped top portion and/or an outwardly flared bottom portion for further directing water away from the post and the pier.

The post and pier can be of any size and shape, and therefore, the body of the assembly can be of any shape. In many embodiments, the pier is generally a cylindrical shaped concrete pier and the post has a rectangular or square cross-section and can be constructed from wood, metal, plastic or a composite. The post can be mounted either directly into the concrete of the pier or to a mounting bracket positioned on the top of the pier. As such, in some embodiments the body can have a substantially cylindrical shape. Additionally, the upper aperture can be a substantially of square, rectangular or round shape adapted for receiving and enclosing the post and the lower aperture can have a substantially round, square, or other shape adapted for receiving and enclosing the pier and can have an aesthetic appearance.

The body of the assembly can be made of any type of material and can include plastic, fiberglass, composite, or metal, by way of example. As noted, the body can be composed of any material. This can include a material that is malleable or modifiable such as to enable a user to cut off a portion of the lower body to adapt the lower portion of the body to the contour of the surface surrounding and supporting the pier. The body can include an outside surface having a textured surface to enhance the look of the body. For example, this can include a texture such as brick, pebble, stone, gothic column, and wood. Additionally, the outside surface can possibly include text or monograms or other customizable visual enhancements. Of course, the outer surface can also be painted to blend with a particular color scheme or design. The body is configured for completely enclosing a top portion of the pier including all portions of the pier exposed above the ground in which the pier is constructed.

As noted above, the body can be of any shape or size. In some cases, it may be desirable to cover a height of a pier or post that is greater than a manufactured length. For example, in building a deck the piers and/or posts can each vary in height due to the contour of the property on which the deck is built. As such, the body can include a top and a plurality of stackable body portions. In this manner, fewer custom assembly parts need be manufactured while still enabling the protective post and pier assembly to be assembled for protecting piers and posts of a large variety of heights. Two or more stackable body portions, having two or more portions as described can be assembled by stacking and coupling and by adding and coupling a top portion defining the upper aperture. These couplings can be applied using adhesive materials or mechanical fasteners.

The body can include an inner surface that defines the cavity. In some embodiments, the inner surface can include one or more members disposed about the inner surface that project inward into the cavity. The members can be configured to contact or engage a portion of an outside surface of the pier when the pier is positioned within the body cavity. By contacting and engaging the outside surface of the pier, the members can provide for a stabilization of the assembly body about the pier and the post. This can be accomplished in some embodiments by having one or more of the members being flexible and deformable to at least partially bend and/or deform when the pier is enclosed within the cavity. The bending or deformation can be resilient to thereby provide a biasing force against the surface of the pier to stabilize the enclosure body about the pier.

In some embodiments, the members can be shaped and positioned to bend or deform such that they are compressed against the pier and center the body about the pier, adapting to deformities on the surface of the pier, and securing and/or stabilizing the body to the pier and post to prevent it from moving or rattling. Additionally, the members can be positioned at an angle such that the deformity or bending exerts a directional force to the body relative to the pier so as to bias the body downward to engage the ground with some force.

The stabilization of the body to the pier and the post can also be provided by filling the cavity and about the pier and the post with a volume filling compound. This can be accomplished, in one embodiment by including a passageway on a top or side of the body for receiving the injection of a filling compound such as a silicone caulk and an expandable foam, by way of example. The passageway can be a punch out, a recessed hole, or a hole with a cover or flap.

In some embodiments, the body is a unified body with a single or multiple piece seal disposed around the upper aperture. This embodiment can be deployed about the post and the pier when access to the top of the post enables the sliding of the assembly down the post to enclose the bottom portion of the post and ultimately all or a portion of the pier.

In other embodiments, the body can be constructed by assembly two or more body portions. This type of body can be suitable for assembling the assembly around a post and a pier after construction and where clear access to the top of the post and pier are not available or convenient. For example, in one embodiment the body includes a first body portion and a second body portion. In such embodiments, the seal can be separately installed or can have multiple portions each attached to one of the body portions.

When multiple body portions are assembled to form the body, a variety of methods and mechanisms can be utilized for coupling the multiple portions together. For example, a collar can be adapted for surrounding the multiple body portions for coupling and forming the body and enclosing the post and the pier within the cavity. Such a collar can be of any type of material and can include a plastic wire tie, or similarly performing collar device, by way of example. In other embodiments, each of the multiple body portions can include one or more mechanisms for coupling, such as slots and tabs, ratchet type devices, cam edges, male and female coupling devices, grooves and slots, by way of example. In other embodiments, edges can be provided that are adapted for receiving an adhesive or sealant.

By way of example of one embodiment, two identical body portions are each a half of the body. One edge of the body can include multiple mechanical fasteners and the second edge of the body can include a corresponding set of coupling fasteners. Each of these can be all male and corresponding female or can be a combination thereof. Generally, in this exemplary embodiment, a single body portion could be manufactured and any two of the portions can be coupled to form the entire body.

Additionally, each one half portion can include one half of the upper aperture and one half of the lower aperture. For example, if a substantially square upper aperture is required, each of the first half of the body and the second half of the body can include one half of a diagonally divided square and wherein the first seal includes two first seal segments, each positioned along one of the two perimeter edges defining the half of the upper aperture of the first half of the body and the second seal includes two second seal segments, each positioned along one of the two perimeter edges defining the half of the upper aperture of the second half of the body. Of course other arrangements for dividing the two portions and/or the upper and lower apertures can also be provided and be within the scope of this disclosure.

In yet other embodiments, the body can be a hinged unitary body having two halves having complementary hinge segments that engage during the coupling of the hinge segments. The hinged body defines a first hinged portion having a first seal coupled thereto and a first free end, a second hinged portion having a second seal coupled thereto and a second free end, and the hinge coupling the first hinged portion to the second hinged portion. In such cases, enclosing includes placing the first hinged portion along first external portions of the pier and the post and rotating the second hinged portion about the hinge, and coupling the second free end of the second hinged portion to the first free end of the first hinged portion. As noted above, the seal can be separate or can include multiple portions. For example, the seal can include a first seal and a second seal and the body can include a hinged body defining a first hinged portion having the first seal coupled thereto, a second hinged portion having the second seal coupled thereto, and a hinge coupling the first hinged portion to the second hinged portion, the hinged body being configured for enclosing the post and the pier upon rotating the second hinged portion about the hinge and towards the first hinged portion into a closed position. Similar coupling mechanisms can be provided for the two free ends of the hinged unitary body as generally described above, but along the one coupling side or seam as defined by the coupled two free ends.

FIG. 1 illustrates a well known post and pier construction that includes a pier 2 having surface 7 (such as a concrete pier) mounted or constructed into ground 3. Pier 2 is typically formed by pouring concrete into a cardboard or other type of pier form. A support structure 4 often is used to offset from the top of the concrete pier 2 with a securing member 6 for securing a post 8 with fasteners (not shown) through each through-hole 10 in each securing member 6. Typical fasteners can include screws, bolts and nails. Over time, exposure to outside environmental elements can result in damage to the concrete pier (e.g., contact with yard maintenance equipment such as lawn mowers and trimmers), corrosion of the fasteners and the securing members 6 and moisture deterioration of the post base 12, thereby weakening the structural support of the post 8 and pier 2. Additionally, such pier 2, the post 8 and the support structure 4 are unattractive. In other embodiments, it is well known that the post 8 can be embedded into the concrete pier 2 or can rest on top of the concrete pier 2.

Figure 2:
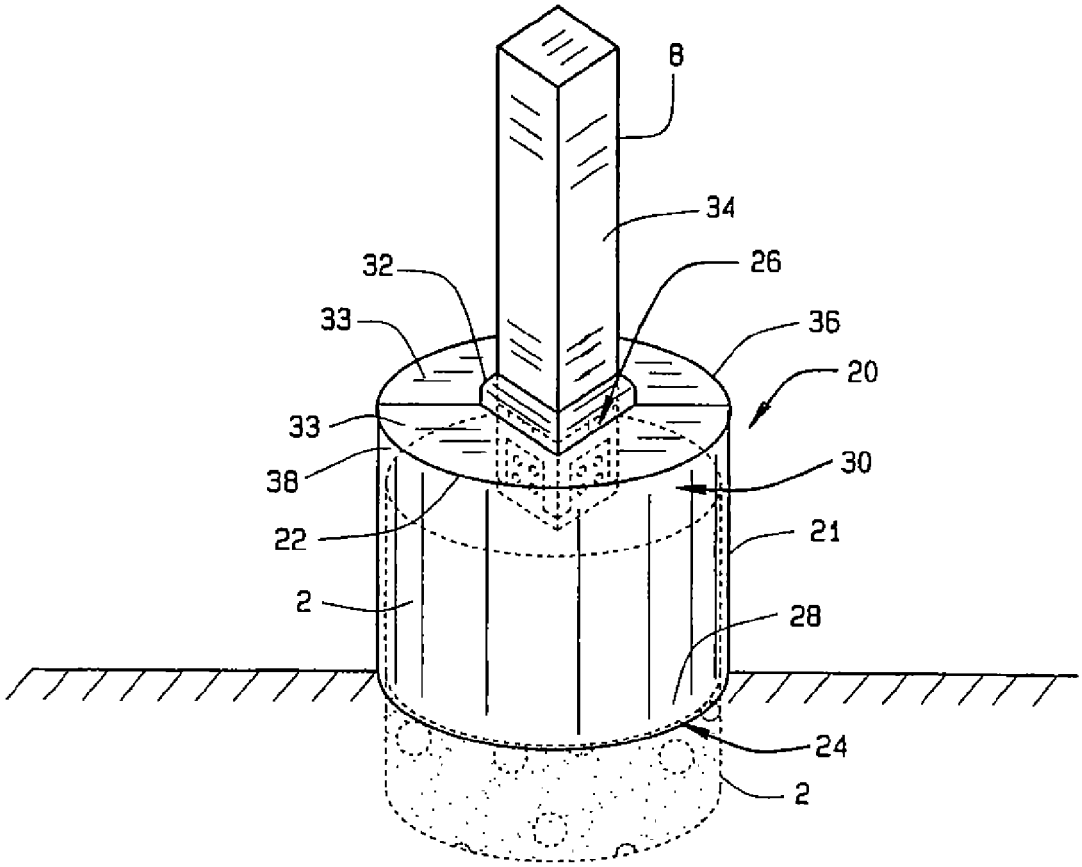
FIG. 2 is an isometric view of a protective base assembly enclosing a pier and a connection between the pier and a post mounted to the pier according to one exemplary embodiment.

Referring to FIG. 2, one exemplary embodiment of an assembly 20 for enclosing and/or protecting a connection between the pier 2 and the post 8 mounted to the pier includes a body 21 having a perimeter wall defining a top end 22, a bottom end 24, an upper aperture 26 disposed around the top end 22, a lower aperture 28 disposed around the bottom end 24, a cavity 30 and a seal 32 disposed proximate the upper aperture 26 for compressively engaging an outer post surface 34 surrounded by the upper aperture 26.

As noted above, the body 21 can be constructed of a material of plastic, fiberglass, composite and a metal. As noted, the body 21 can be a single unitary body or can include multiple body portions. As shown in FIG. 2, the body 21 has a first half portion 36 coupled to a second half portion 38 wherein each half portion compressively engages the pier 2 and the post 8. The seal 32 of each half portion 36, 38 can provide a compressive force against the outer post surface 34 and interior surfaces of the body wall cavity 30 can provide a compressive force against the pier 2 to thereby capture and redirect water flowing down the outer post surface 34 of the post 8.

Figure 3:
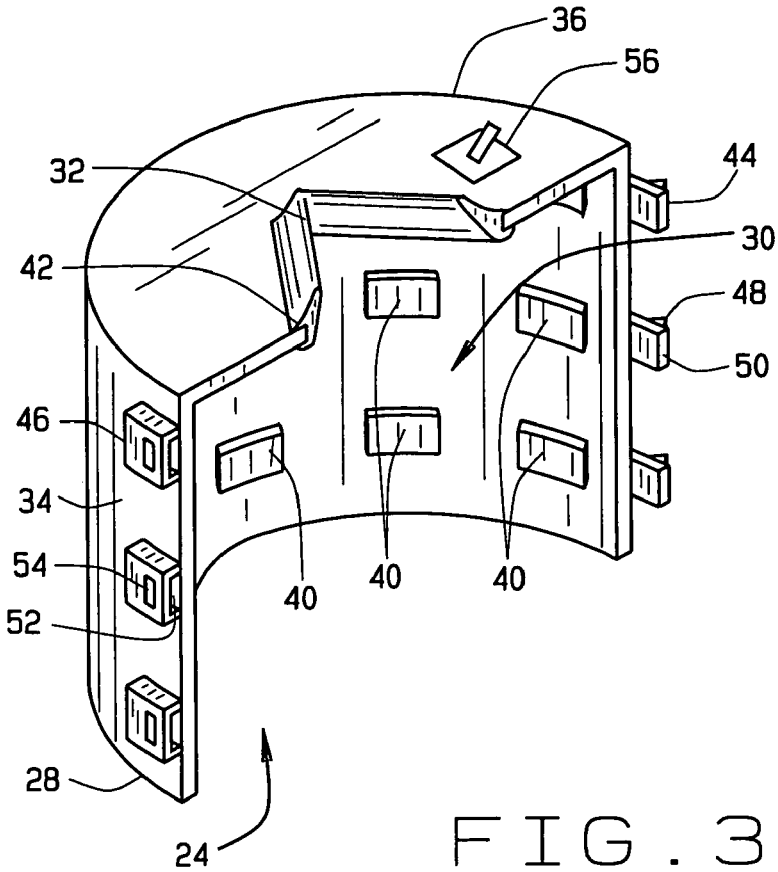
FIG. 3 is an isometric view of one half of a two-part protective base assembly according to another exemplary embodiment.

Referring now to FIG. 3, an embodiment of an assembly body half portion 36 is illustrated wherein the structure of each body half portion 36, 38 is identical. One or more members 40 in some embodiments can extend inwardly and upwardly from interior walls of the body 21 and can be constructed of a flexible material that can provide a compressive force to the pier 2 when the two halves 36, 38 are coupled together. When angled the members 40 can provide an upwardly biased force from the interior wall defining the cavity 30, the resulting compressive force can have both a radial and a downward component, thereby stabilizing the assembly body 21 to the pier 2 and ground 3. In other embodiments, the members 40 can be structured to closely couple to interfacing surface textures of the pier 2.

Also shown in FIG. 3, the seal 32 can have a concave surface 42 that can direct fluids away from the outer post surface 34 when the body halves 36, 38 are engaged. In this embodiment, the coupling engagement can be achieved when a male tab member 50 is inserted into a female receiving member 52. A slot 54 in the U-shaped female member 52 receives the protruding tip 48 for securing the male member 50 in a locking manner. The body halves 36, 38 can be disengaged by depressing the protruding tips of each male member 50 in each female slot 54.

Once the body halves 36, 38 are engaged as previously described, a filling compound (not shown) can be injected into the body cavity 30 through a passageway 56 that couples the outer post surface 34 to the cavity 30, thereby providing a tighter sealing of the assembly to the pier 2 and post 8. As is known in the art, one or more passageways 56 can be located around the body 21 to couple to the cavity 30.

Figure 4:
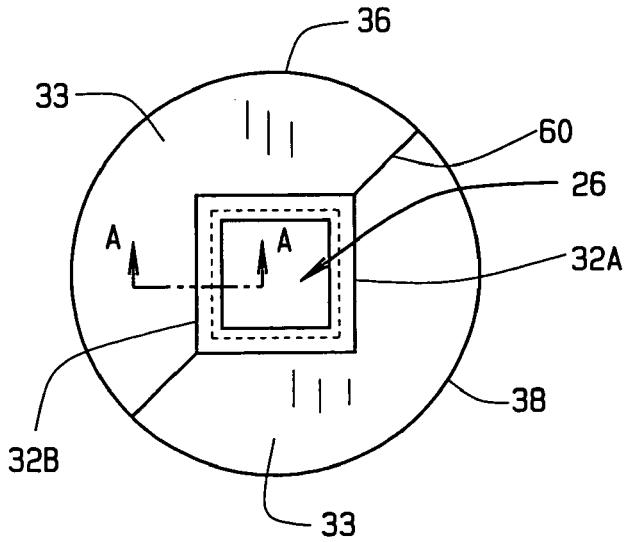
FIG. 4 is a top view of a protective base assembly according to one exemplary embodiment.

FIG. 4 is a top view of a protective base assembly according to one exemplary embodiment showing body half portions 36 and 38, seals 32A and 32B and upper aperture 26 that is defined by the interfacing top body surface halves. In this embodiment, the aperture is of square shape and the aperture segments are symmetrical about the body diagonal 60. Cross-section A-A is a cut-through of the upper surface body and the aperture seal 32.

FIG. 5 illustrates various embodiments 5A, 5B, 5C and 5D of seal 32 in relation to a top surface 33 of the body associated with the top end 22 and the upper aperture 26 defined by the top surfaces of the two body halves 36 and 38. Each embodiment is structured to direct and deflect fluids away from the post 8 when engaged to the post 8.

Figure 5A:
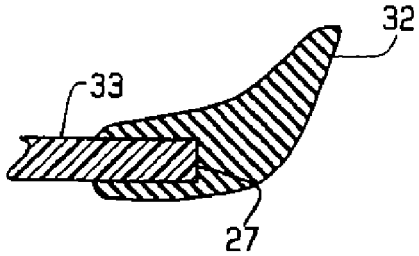
FIGS. 5A-5D are cross-sectional views of four different exemplary embodiments of seals and the seals coupling to the top end and the top aperture.

The seal 32 embodiment of FIG. 5A, as cross-section A-A, illustrates a seal member having a general U-shape interface to the upper aperture 26 with a tongue-shaped tip extending interiorly and curving vertically. The interior base of the U-shaped seal can engage the interior edge 27 of top surface 33 that defines upper aperture 26. Seal 32 can be secured to the upper aperture 26 and top surface 33 using an adhesive, by way of example.

Figure 5B:
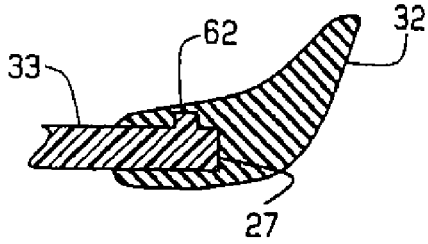

FIG. 5B illustrates a second exemplary embodiment of a seal 32 that includes an upper aperture 26 defined by the top surface 33 that can also include surface protrusion 62 running parallel to the upper aperture 26. The surface protrusion 62 can provide an additional sealing engagement surface for seal 32 and provide added seal stability. The seal 32 includes a channel that engages the surface protrusion 62. The interior base of the U-shaped seal 32 is configured to engage the interior edge 27 of top surface 33 that defines upper aperture 26. Seal 32 can also be secured to the upper aperture 26 and top surface 33 using an adhesive, by way of example.

Figure 5C:
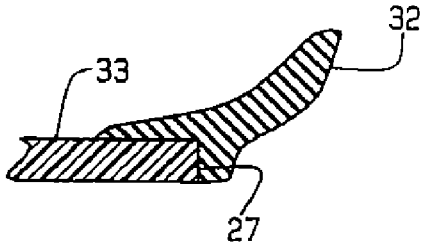

Referring to FIG. 5C, a third exemplary cross-section A-A embodiment of the seal 32 has a general T-shaped cross-sectional structure, wherein the left half of the T interfaces to the top surface 33 and interior edge 27 of top surface 33 with the base of the T dimensioned with the same depth as interior edge 27. The right portion of the T-shaped seal 32 is slanted vertically and both of the top ends of the T-shaped seal are tapered to deflect and guide fluids away from post 8 when the body halves 36, 38 are engaged. The seal 32 can be secured to the upper aperture 26 and top surface 33 using an adhesive, by way of example.

Figure 5D:
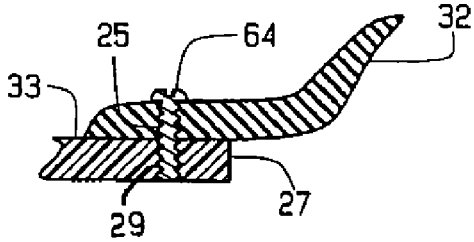

FIG. 5D illustrates another exemplary embodiment of the seal 32 having a general L-shape with the tip of the base of the L engaging the post 8 and the longer vertical member of the L-shaped seal 32 engaging the upper surface 33 with a fastener 64. As shown, the vertical member of the L-shaped seal 32 extends beyond the interior edge 27 of top surface 33. In this embodiment, the top surface 33 includes a hole 29 for receiving fastener 64. The hole 29 can be a threaded, smooth, partially threaded/partially smooth, by way of example. The fastener 64 can be a bolt, a rivet, a staple, a screw, and stitching, by way of example. The seal 32 can be constructed with a seal through-hole 25 that can provide a passageway for the fastener 64 to secure the seal 32 to the top surface 33. In some embodiment, the seal through-hole 25 can be smooth, threaded, partially smooth/partially threaded, by way of example. Other embodiments of seal 32 can be applied to a post and pier enclosure assembly 20 and the disclosed exemplary structures herein for seal 32 are not intended to limit the scope of the invention.

Figure 6:
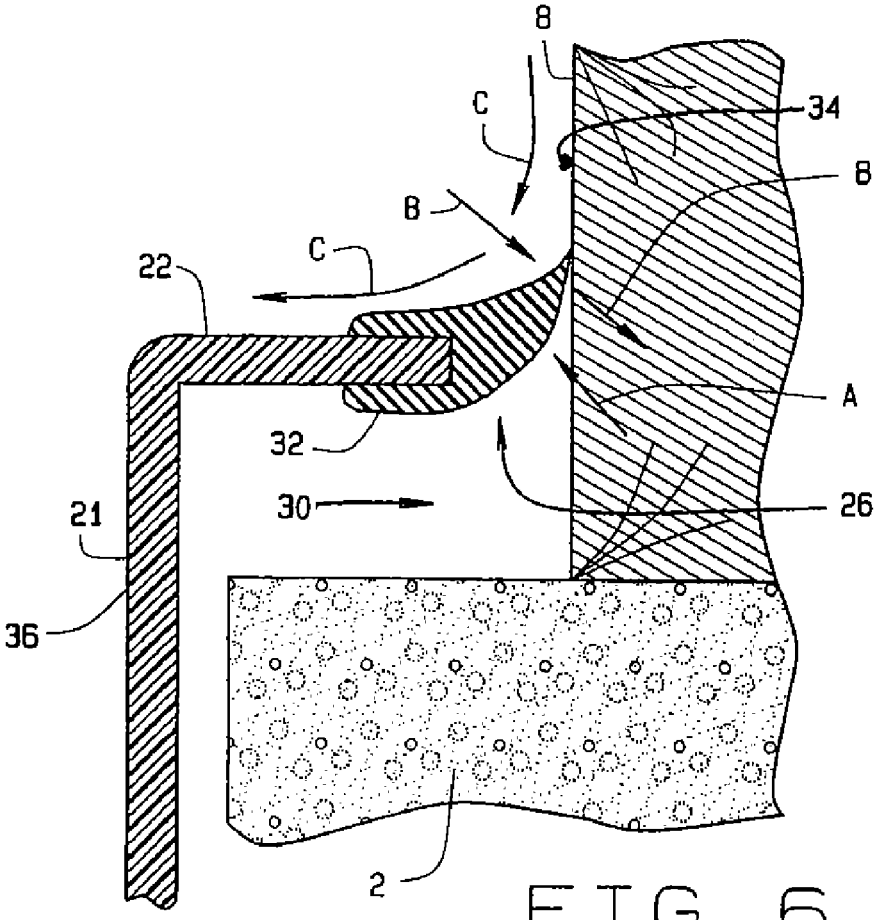
FIG. 6 is a partial cross-sectional view of a seal and top end compressively engaging an outer surface of a post and water flow about the post and the seal according to one exemplary embodiment.

FIG. 6 shows a partial cross-sectional view of an embodiment of an assembly 20 for enclosing a connection between a pier 2 and a post 8 mounted to the pier 2. In the illustrated embodiment, the seal 32 compressively engages the outer surface 34 of post 8 and guides a flow of water or debris (indicated by arrow C) about the post and away from the post 8 and the cavity 30. In some embodiments, the top end 22 of the body 21 can be sloped downward and away from the post 8 to further guide water away from the post 8 and the cavity 30. The deflection of the seal 32 is shown by Arrow A. This deflection occurs during enclosing of the body 21 about the post 8 and the pier 2 as the seal 32 is composed of a flexible material and extends into the upper aperture 26 for engaging the outer surface 34 of the post 8. The seal 32 is composed of a resilient material and applies a continued biasing or force (as shown by arrow B) against the outer surface 34 of the post 8.

Figure 7A:
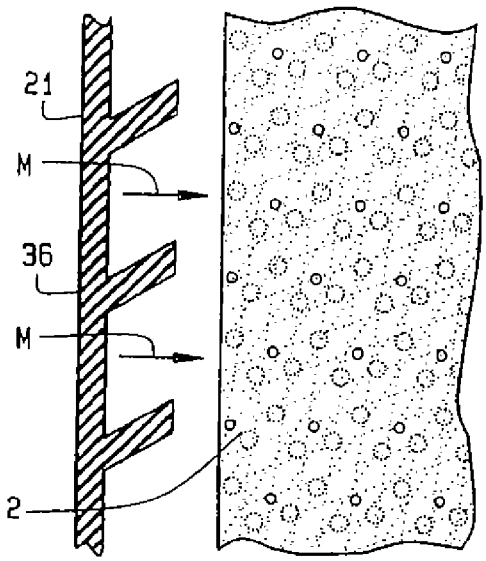
FIGS. 7A and 7B are partial cross-sectional views of the inner surface of the base having a plurality of members disposed for engaging the outer surface of the pier with FIG. 7A illustrating the position of the members prior to engagement with the pier and FIG. 7B illustrating the deformed members following engagement with the pier according to one exemplary embodiment.
Figure 7B:
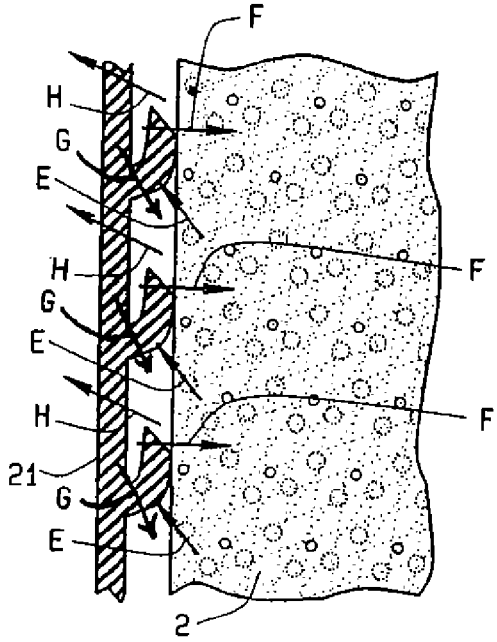

FIG. 7 includes two partial cross-sectional views, FIGS. 7A and 7B, of the inner surface of the body 21 having a plurality of members 40 disposed for engaging the outer surface 7 of the pier 2. FIG. 7A illustrates the position of the members 40 prior to engagement with the pier 2 and FIG. 7B illustrates the deformed members 40 following engagement with the pier 2 according to one exemplary embodiment. The arrows M of FIG. 7A illustrate in the cross-section the movement of the body 21 toward the pier 2 during the enclosing of the pier 2 and post 8. Subsequent to engagement, the members 40 are illustrated in their deflected position E in FIG. 7B. As shown, the members 40 are deformed or deflected upward (shown as arrow E) upon engagement of the body 21 with the pier 2. Upon deflection, each member 40 provides a downwardly diagonal biasing or force (shown by arrow F) against the outer surface 7 and the pier 2. Of course, as is known in the art, this can include force components G and H that can provide downwardly compressive and outwardly compressive forces, G and H, respectively. These mechanical biases and force components further stabilize assembly 20 subsequent to engagement to pier 2.

Figure 8:
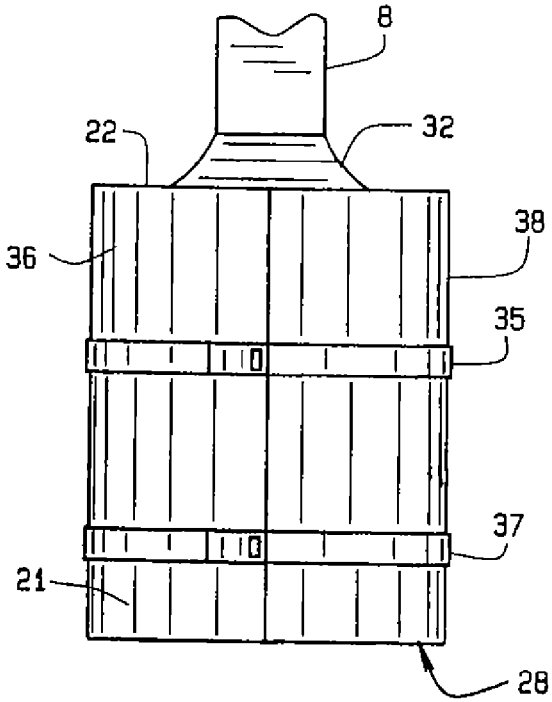
FIG. 8 is a side view of a protection base assembly having two collars for coupling the base about the pier and the post according to one exemplary embodiment.

Referring to FIG. 8, another embodiment of the protection assembly 20 is illustrated that includes two body portions 36 and 38, seal 32 and two collars 35, 37 for securing body portion 36 to body portion 38 for forming body 21 and therefore for engagement of assembly 20 to post 8 and pier 2 (not shown in FIG. 8). The collars 35, 37 can include belt-like or a tie-wrap or similar structures and configurations, that are typically used on an assembly 20 where an aesthetic external appearance is not required. In other embodiments, a tape can be used as collars 35, 37. The application of the collars 35, 37 to engage the assembly 20 to the pier 2 and the post 8, in some embodiments, can provide for quicker installation and removal of the assembly 20.

Figure 9:
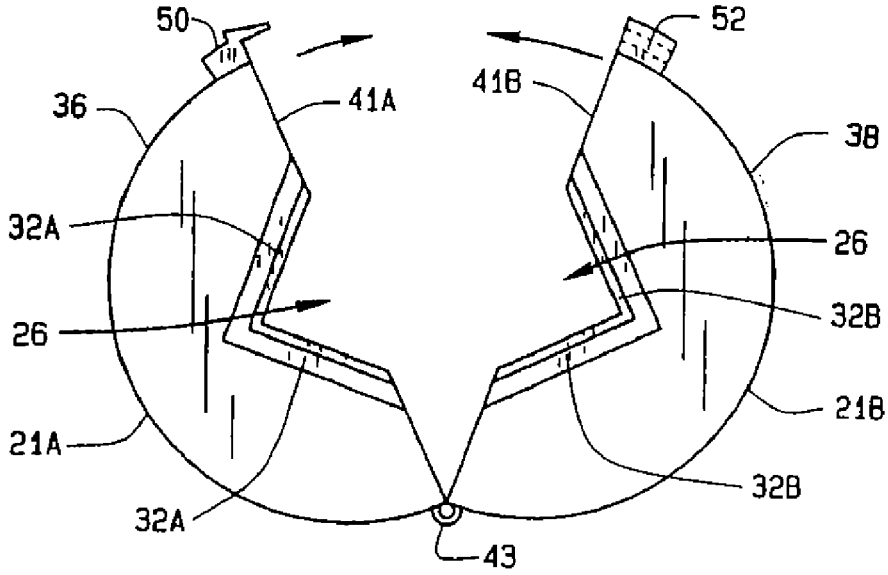
FIG. 9 is a top view of a protection base assembly having a hinged body according to one exemplary embodiment.

FIG. 9 illustrates another embodiment of a protection assembly 20 having a hinged unitary body that can have lower manufacturing costs, e.g., a single extruded plastic body, by way of example. The body 21 includes a hinge 43, two body portions 21A and 21B with and two free ends 41A and 41B, respectively. One or both body portions 21A and/or 21B pivots about hinge 43 to enclose the pier 2 and the post 8. As shown, the engagement is secured by coupling. For example, as shown in FIG. 9. the male member 50 of body portion 21A can be inserted into female members 52 of the body portion 21B. Each body portion 21A and 21B can include a portion of the seal 32, shown as 32A for a first body 21A portion and 32B for a second body 21B portion. In this example, the upper aperture 26 is illustrated as a square aperture that is defined in halves by each of body portions 21A and 21B. Of course in other embodiments, other aperture shapes are possible and can be at least partially defined by body portions 21A and 21B. In some hinged unitary body embodiments, a securing collar 35, 37 can be used to enclose pier 2 and post 8 as an alternative than male 50 and female 52 members. Additionally, in other embodiments the hinged body 21 can be assembled by more than one separate body portion and can not be constructed as a unitary body.

FIG. 10 illustrates four embodiments 10A-D each having a different exemplary outside textured surface 33 (shown as 33A-33D) of the body 21 of an assembly 20. Textured body surfaces 33 can include brick, pebble, stone, gothic column and wood, by way of example.

Figure 10A:
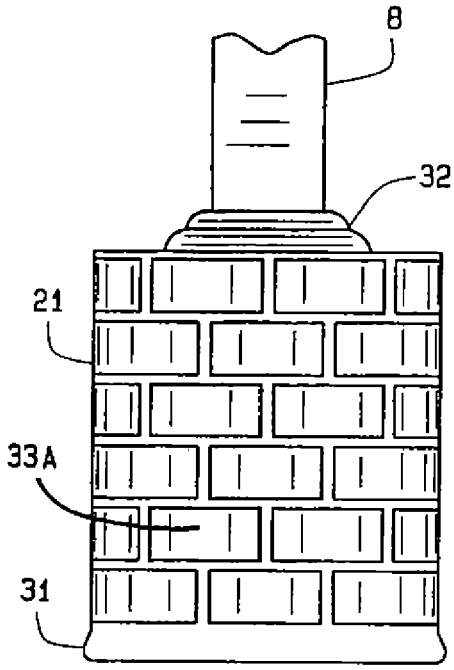
FIGS. 10A-10D are side views of four different outer body styles and four different outer surface textures according to various exemplary embodiments.

FIG. 10A shows assembly 20 protectively enclosing post 8 and pier 2 (not shown), having the seal 32 and the body 21 with a stone surface 33A. The seal 32 has a two-tiered rounded profile in this exemplary embodiment. Other seals 32 can be used with the stone-textured body and the illustrated seal is not intended to limit the scope of the stone-textured body. Also, the body 21 can also include a bottom flange 31 for further directing the flow of water away from the assembly 20 and the pier 2.

Figure 10B:
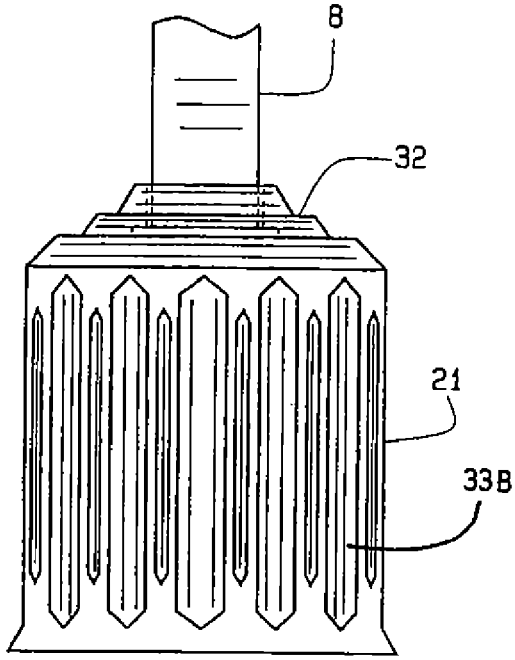

FIG. 10B shows protective assembly 20 enclosing post 8 and pier 2 (not shown), having seal 32 and body 21 with a gothic surface 33B. The seal 32 has a two-tiered straight slope profile in this embodiment. Other seals 32 can be used with the gothic-textured body 33B and the illustrated seal 32 is not intended to limit the scope of the gothic-textured body.

Figure 10C:
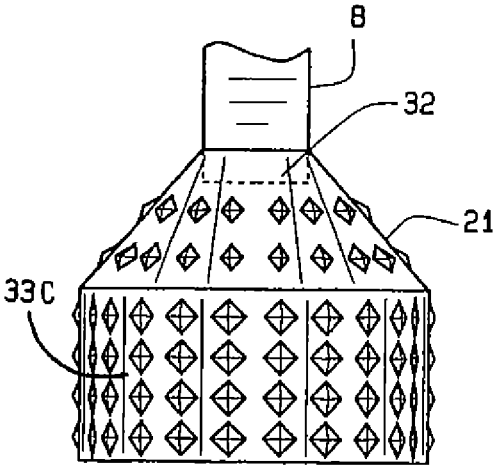

FIG. 10C shows protective assembly 20 enclosing post 8 and pier 2 (not shown), having seal 32 and body 21 with a pebble surface 33C. The seal 32 has a single straight slope profile in this embodiment. The body 21 is shown as a truncated cone on top of a cylinder. Other body profiles and other seals 32 can be used with the pebble-textured body 33C and the illustrated body 21 and the seal 32 are not intended to limit the scope of the pebble-textured body 33C.

Figure 10D:
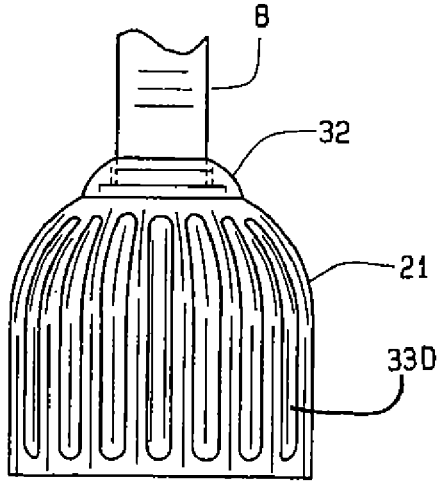

FIG. 10D shows assembly 20 protectively enclosing post 8 and pier 2 (not shown), having seal 32 and body 21 with a rounded gothic-textured surface 33D. The seal 32 also has a rounded profile in this embodiment to complement the rounded body 21. Other seals 32 can be used with the rounded gothic-textured body and the illustrated seal is not intended to limit the scope of the rounded gothic-textured body.

Figure 11:
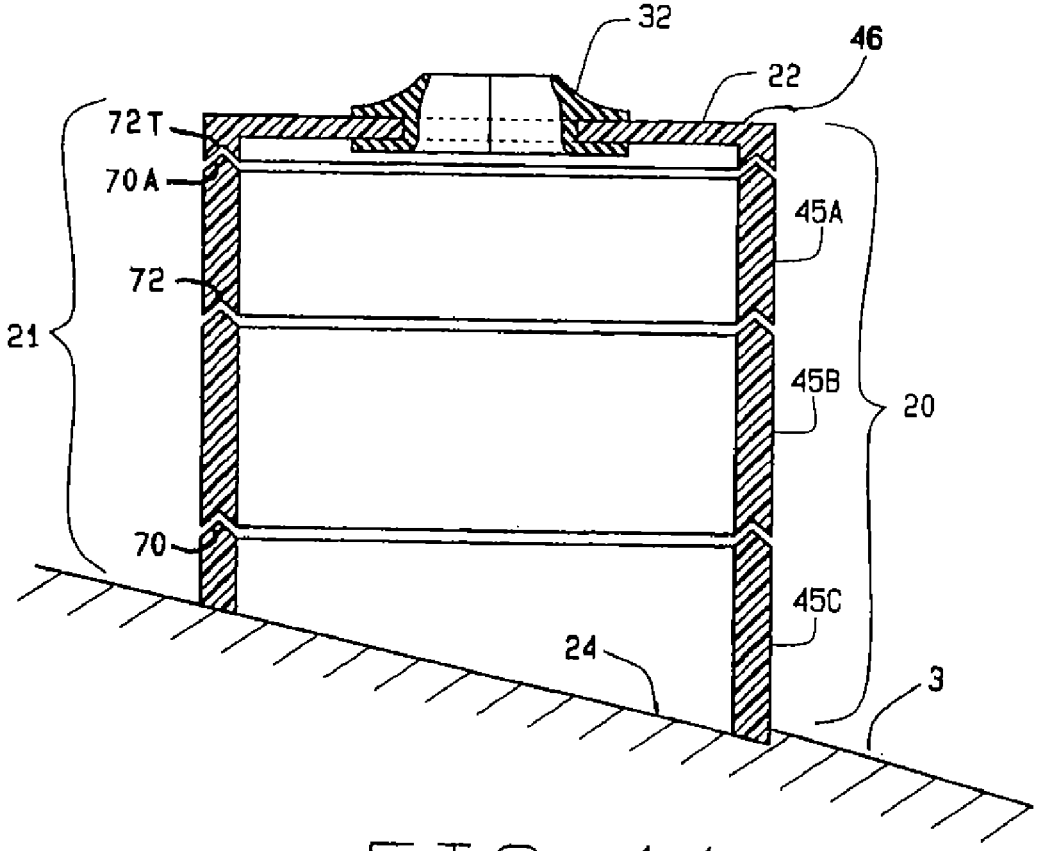
FIG. 11 is a cut-away side view of a protective base assembly assembled with a top section and three stackable sections defining the perimeter walls according to another exemplary embodiment.

FIG. 11 illustrates a cross-section cut-away view of an assembly 20 and body 21 having a plurality of stackable body sections 45A, 45B, and 45C a stackable top section 46 defining the top surface 22. The pier 2 and the post 8 are not shown so as to better illustrate the stacking configuration. The embodiment shown accommodates pier structures having varying heights, widths and upper aperture shapes.

The protective assembly 20 has been installed on ground having a negative slope, as may exist near the foundation of a building where the ground has been graded to channel water away from a building structure. Three stackable body sections 45A-C are shown with a top body section 46 serving as a cap to the stacked assembly and defining the top surface 22 and the upper aperture 26. The lower stackable section 45C defines the bottom end 24 and the lower aperture 28. A portion of the bottom end 24 has been cut or formed to fit or align with the downward slope of the surface 44 of the ground 3.

The seal 32 is engaged to the top section 46 to complete the protective assembly 20. Each stackable body section 45A-C can have perimeter extensions 70 and perimeter recessions 72 that function as key-like structures to secure one stackable body section 45A-C to another stackable body section 45A-C. The stackable top section 46 can include similar recessed keying structure 72T to engage extension 70A of the stackable body section 45A. While not shown, the stacking configuration of FIG. 11 can also include an engaging collar 35, 37 encompassing adjacent body sections 45A-C and/or 46 and an engaging collar 35, 37 between the stackable top section 46 and its adjacent stackable body section 45A to further secure the assembly 20. To further secure the assembly 20, adhesive materials can also be applied between an two adjacent stackable body sections 45A-C, and top section 46, such as to the keying structures.

As shown, the stackable body sections 45A-C and the top section 46 can be of a unitary construction. While the illustrated embodiment of FIG. 11 is shown as having three stackable body sections 45A-C, fewer or more body sections 45 can be configured to meet the requirements for a given pier height, and the illustrated embodiment is not intended to limit the scope of the invention. In other embodiments, an alternative body 21 can include two or more segmented half portions (not shown) per body section 45 in a stackable configuration and the illustrated stacking embodiment is not intended to limit the scope of the disclosure.

In operation, a method of covering a pier and post mounted to the pier includes enclosing a portion of the pier and the bottom portion of the post within a cavity of a body and compressively engaging a seal about an outer surface of the post for preventing fluid located about the post from entering the cavity.

As noted above, in some embodiments the body can include one or more members formed about an inner surface defining the cavity that project into the cavity. In such embodiments, the method can include compressively engaging one or more members against the outside surface of the pier to at least partially secure the body to the pier. In some embodiments, the securing of the body to the pier can be provided by filling, at least a portion of, the cavity and about the pier and the post with a volume filling compound.

As noted above, in some embodiments, the body is a unified body wherein the process can include sliding of the body or assembly down the post to enclose the bottom portion of the post and ultimately all or a portion of the pier. In the embodiments where the body is composed of a plurality of body portions, the process of enclosing includes placing the first body portion adjacent to or about an external portion of the pier and the post and placing the second body portion adjacent to or about the second external portions of the pier and the post. The first body portion is then coupled to the second body portion and about the post and the pier. This will also result in the compressive engagement of the seals to the outer surface of the post.

One or more mechanical fasteners can be separate from or integral to the body portions for securing the multiple body portions. In other embodiments, an adhesive material can be used to secure the body portions. These mechanical fasteners can be permanent or releasable. In the later case, the method can include decoupling the first body portion from the second body portion, removing the first body portion and the second body portion from about the pier and the post. As noted above, with the removal of the body portions, the seal is also removed from its compressive engagement about the outer surface of the post.

In yet other embodiments, the body can be a hinged body. As noted above, enclosing the post and pier with such a hinged body can include placing the first hinged portion along first external portions of the pier and the post and rotating the second hinged portion about the hinge, and coupling the second free end of the second hinged portion to the first free end of the first hinged portion. Coupling fasteners, a collar, or adhesives, by way of example, can be utilized to couple the free ends together to secure the hinged body about the post and the pier.

Figure 12:
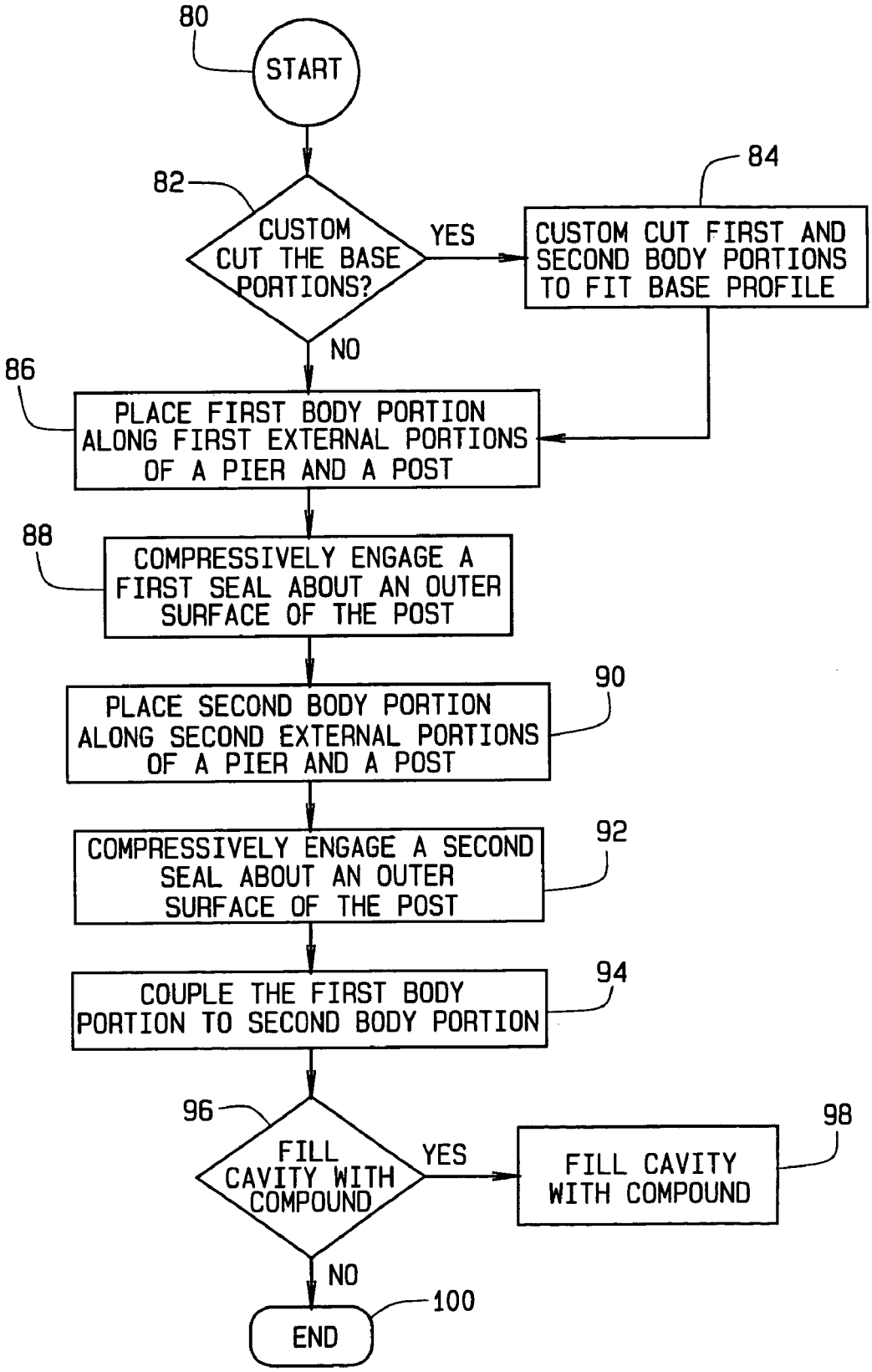
FIG. 12 is a flow chart illustrating a method of enclosing a post and a pier according to some embodiments.

FIG. 12 illustrates a method of covering a pier and a post mounted to a pier. The method starts at process 80 by determining whether a body portion must be custom fit to an installation in process 82. If required, the base is custom cut in process 84. If not, a first body portion is placed along first external portions of a pier 2 and a post 8 in process 86. In process 88, the first seal portion of the first body portion is compressively engaged to an outer surface of the post that is to be protectively enclosed. Next, in process 90, a second body portion is placed along a second external portion of the pier 2 and post 8, compressively engaging a second seal about an outer surface of the post in process 92. In process 94, the first body portion is coupled to the second body portion. As previously presented, such coupling can include the use of collars 35, 37 or interconnecting male members 50 to female receiving members 52. In process 96, if it is desired to fill the cavity with a volume filling compound, the cavity is filled in process 98. If not, the method ends in process 100 and the covering of a pier and a post mounted to a pier has completed. FIG. 12 illustrates just one exemplary embodiment of a method of covering a post and pier assembly as described by this disclosure and other embodiments of methods consistent with the disclosure are considered to also be within the scope of the disclosure.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. An assembly for enclosing a connection between a pier and a post mounted to the pier, the assembly comprising:

a body having a first portion and a second portion coupled together to form the body, a perimeter wall defining a top end and a bottom end, an upper aperture disposed round the top end, a lower aperture disposed around the bottom end, and a cavity dimensioned for enclosing substantially all above ground portions of the pier, a lower portion of the post adjacent to a top of the pier and a coupling of the post and the pier; and a seal disposed proximate the upper aperture for compressively engaging an outer surface of the post surrounded by the upper aperture, the seal having a first seal portion coupled to the first body portion and a second seal portion coupled to the second body portion.

2. The assembly of claim 1 wherein the first seal portion is positioned about the upper aperture and the second seal portion projects into the upper aperture and adapted for deflecting upwardly and providing the compressive engagement to the outer surface of the post.

3. The assembly of claim 1 wherein the body has a substantially cylindrical shape and the upper aperture has a substantially square shape and the lower aperture has a substantially round shape.

4. The assembly of claim 1 wherein the body includes a material selected from the group consisting of a plastic, a fiberglass, a composite, and a metal.

5. The assembly of claim 1 wherein the body includes an inner surface defining the cavity, further comprising at least one member disposed about the inner surface and projecting inwardly into the cavity for contacting a portion of an outside surface of the pier positioned within the cavity, wherein the at least one member is flexible and configured to, at least partially, deform when the pier is placed within the cavity and substantially coincidental with the seal compressively engaging with the outer surface of the post.

6. The assembly of claim 1, further comprising a collar adapted for coupling about an outer surface of the perimeter walls of each of the first body portion and the second body portion for forming the body and enclosing the post and the pier within the cavity.

7. The assembly of claim 1 wherein the first body portion includes at least one first latching mechanism and the second body portion includes at least one second latching mechanism, the first and second latching mechanisms being configured for latching with each other for securing the second body portion to the first body portion.

8. The assembly of claim 7 wherein the at least one first latching mechanism includes a male-oriented latching coupler and the at least one second latching mechanism includes a female-oriented latching coupler adapted for receiving and securing the male oriented latching coupler.

9. The assembly of claim 8 wherein each of the first body portion and second body portion includes at least one male-oriented latching mechanism on a first end and at least one female latching mechanism on an opposing second end, and wherein each male-oriented latching mechanisms of each body portion are configured for coupling with a corresponding female-oriented latching mechanism of the other body portion.

10. The assembly of claim 7 wherein the at least one first latching mechanism includes a tab and the at least one second latching mechanism includes slot adapted for receiving and securing the tab.

11. The assembly of claim 1 wherein the first body portion is identical to the second body portion.

12. The assembly of claim 1 wherein the upper aperture has a substantially square shape and the lower aperture has a substantially round shape and wherein the first body portion is a first half of the body and the second body portion is a second half of the body.

13. The assembly of claim 1 wherein the first body portion and the second body portion are each halves of the body and each defines one half of a substantially square upper aperture and wherein one half of the substantially square upper aperture of each body portion includes one half of a diagonally divided square and wherein the first seal portion includes two first seal segments, each positioned along one of the two perimeter edges defining the half of the upper aperture of the first body portion and the second seal portion includes two second seal segments, each positioned along one of the two perimeter edges defining the half of the upper aperture of the second body portion.

14. The assembly of claim 1, further comprising at least one hinge coupling the first body portion to the second body portion forming a hinged body configured for enclosing the post and the pier upon rotating the second body portion about the hinge and towards the first body portion into a closed position.

15. The assembly of claim 14, further comprising a collar adapted for coupling about an exterior surface of the perimeter wall of the hinged body for securing the hinged body in the closed position.

16. The assembly of claim 14 wherein the first body portion includes at least one first latching mechanism and the second body portion includes at least one second latching mechanism, the at least one first latching mechanism and the at least one second latching mechanism being coupleable with each other for securing the second body portion to the first body portion when in the closed position.

17. The assembly of claim 16 wherein the at least one first latching mechanism includes a mate-oriented latching coupler and the at least one second latching mechanism includes a female-oriented latching coupler adapted for receiving and releasable securing the male oriented latching coupler.

18. The assembly of claim 1 wherein the body is configured for completely enclosing a top portion of the pier including all portions of the pier exposed above a ground surface in which the pier is constructed.

19. The assembly of claim 1 wherein an outside surface of the body includes a textured surface selected from the group consisting of brick, pebble, stone, gothic column, and wood.

20. The assembly of claim 1 wherein the body defines a passageway coupling an outside surface of the body to the cavity for receiving a volume filling compound into the cavity of the body, the passageway being independent of the upper aperture and independent of the lower aperture.

21. The assembly of claim 20 wherein the passageway is selected from the group consisting of a punch out, a port, a recessed hole, or a hole with a cover or a flap.

22. The assembly of claim 1 wherein the body includes a top section defining the top end and the upper aperture and a plurality of stackable sections defining the perimeter wall with at least one of the stackable sections defining the bottom end and the lower aperture, each of the top sections and the stackable sections having the first body portion and the second body portion and being configured for vertically joining to form the body.

23. A protective base for a post mounted to a pier comprising:

means for enclosing a bottom portion of the post and a top portion of the pier exposed above a ground surface in which the pier is constructed, and a previous coupling of the post to the pier;

means for preventing fluid located about the post from entering into a cavity defined by the means for enclosing; and means for at least partially securing the means for enclosing to the pier.

24. A method of covering a pier and post mounted to the pier, the method comprising:

enclosing substantially all above ground portions of the pier and a lower portion of the post adjacent to a top of the pier and a coupling of the post and the pier within a cavity of a body having a perimeter wall defined by a first body portion attached to a second body portion, a top end defining an upper aperture for enclosing the post and a bottom end defining a lower aperture for enclosing the pier, and wherein enclosing includes placing the first body portion along first external portions of the pier and the post, placing the second body portion along second external portions of the pier and the post, and coupling the first body portion to the second body portion; and compressively engaging a seal having a first seal portion coupled to the first body portion and a second seal portion coupled to the second body portion about an outer surface of the post during the coupling of the first body portion with the second body portion for preventing fluid located about the post from entering the cavity.

25. The method of claim 24 wherein the body includes at least one member formed about an inner surface defining the cavity and projecting inwardly into the cavity, further comprising compressively engaging the at least one member against an outside surface of the pier and, at least partially, securing the body to the pier substantially coincidental with the compressive engagement of the seal about the outer surface of the post.

26. The method of claim 24 wherein coupling the first body portion to the second body portion includes using at least one of a pair of mating latching mechanism associated with each body portion and encircling an outer surface of the perimeter wall of the body with a collar.

27. The method of claim 24 wherein the body includes a hinge coupling the first body portion having a first free end to the second body portion having a second free end, and wherein enclosing includes placing the first body portion along first external portions of the pier and the post and rotating the second body portion about the hinge, and coupling the second free end of the second body portion to the first free end of the first body portion.

28. The method of claim 24, further comprising cutting off a portion of the body to adapt the lower portion of the body to a surface contour about the pier.

29. The method of claim 24, further comprising filling, at least a portion of, the cavity containing the pier and the post with a volume filling compound.

30. The method of claim 24 wherein enclosing a portion of the pier includes completely enclosing the portion of the pier exposed above a ground, and wherein enclosing further includes coupling a plurality of stackable body portions together to completely enclose the exposed portion of the pier.

31. An assembly for enclosing a connection between a pier and a post mounted to the pier, the assembly comprising:

a body having a perimeter wall defining a top end and a bottom end, an upper aperture disposed around the top end, a lower aperture disposed around the bottom end, and a cavity, the body having a first body portion and a second body portion, wherein the upper aperture has a substantially square shape and the lower aperture has a substantially round shape and wherein the first body portion is a first half of the body and the second body portion is a second half of the body; wherein the first half of the body and the second half of the body each define one half of the substantially square upper aperture; wherein the defined one half of the substantially square upper aperture of each of the first half of the body and the second half of the body includes one half of a diagonally divided square; and a seal disposed proximate the upper aperture for compressively engaging an outer surface of the post surrounded by the upper aperture, wherein the seal includes a first seal coupled to the first body portion and a second seal coupled to the second body portion; and wherein the first seal includes two first seal segments, each positioned along one of the two perimeter edges defining the half of the upper aperture of the first half of the body and the second seal includes two second seal segments, each positioned along one of the two perimeter edges defining the half of the upper aperture of the second half of the body.

32. An assembly for enclosing a connection between a pier and a post mounted to the pier, the assembly comprising:

a body having a perimeter wall defining a top end and a bottom end, an upper aperture disposed around the top end and dimensioned for filling about the post, a lower aperture disposed around the bottom end and dimensioned for fining about the pier, and a cavity dimensioned for enclosing a lower portion of the post, substantially all exposed portions of the pier and the connection between the post and the pier, the body having a first body portion and a second body portion, wherein the first body portion is a first half of the body and the second body portion is a second half of the body, and wherein the first half of the body and the second half of the body each define one half of the upper aperture and one half of the lower aperture; and a seal disposed proximate the upper aperture for compressively engaging an outer surface of the post surrounded by the upper aperture, wherein the seal includes a first seal portion coupled to the first body portion and a second seal portion coupled to the second body portion.

* * * * *